United States Patent [19]

Takahashi et al.

[11] Patent Number: 4,485,170

[45] Date of Patent: Nov. 27, 1984

[54] PHOTOGRAPHIC SILVER HALIDE LIGHT-SENSITIVE MATERIAL

[75] Inventors: Yasuo Takahashi; Takashi Fujioka; Yasuhiro Nakayama, all of Shizuoka, Japan

[73] Assignee: Fuji Photo Film Co., Ltd., Kanagawa, Japan

[21] Appl. No.: 465,372

[22] Filed: Feb. 10, 1983

[30] Foreign Application Priority Data

Feb. 10, 1982 [JP] Japan ..... 57-20049

[51] Int. Cl.[3] ..... G03C 1/72

[52] U.S. Cl. ..... 430/627; 430/628

[58] Field of Search ..... 430/536, 537, 539, 627, 430/628, 631, 523

[56] References Cited

U.S. PATENT DOCUMENTS

| | | | |
|---|---|---|---|
| 2,760,864 | 8/1956 | Griggs et al. | 430/537 |
| 2,865,753 | 12/1958 | Griffin et al. | 430/628 |
| 3,861,918 | 1/1975 | Fitzgerald | 430/628 |
| 4,232,111 | 11/1980 | Miyazaka et al. | 430/537 |
| 4,291,120 | 9/1981 | Kobayashi et al. | 430/536 |
| 4,358,534 | 11/1982 | Sasaki et al. | 430/537 |
| 4,366,238 | 12/1982 | Yokoyama et al. | 430/627 |

*Primary Examiner*—Jack P. Brammer

*Attorney, Agent, or Firm*—Sughrue, Mion, Zinn, Macpeak, and Seas

[57] ABSTRACT

A photographic silver halide light-sensitive material is described. The material is comprised of a support with at least one gelatin-containing hydrophilic layer provided thereon. The gelatin-containing hydrophilic layer contains a styrene-butadiene copolymer latex. With this photographic silver halide light-sensitive material, the formation of fog and desensitization occur less if it is bent or sucked during the production, working, and development thereof. There is thus provided a light-sensitive material which is improved in its resistance against mechanical stresses without causing a loss of transparency during development, and further, without increasing its surface electric resistance.

6 Claims, No Drawings

PHOTOGRAPHIC SILVER HALIDE LIGHT-SENSITIVE MATERIAL

FIELD OF THE INVENTION

The present invention relates to a photographic silver halide light-sensitive material (hereinafter referred to as a "light-sensitive material"), and more particularly, to a light-sensitive material which is improved in its resistance against mechanical stress.

BACKGROUND OF THE INVENTION

In general, when a light-sensitive material is subjected to mechanical stresses such as twisting, bending, and suction during the production process, or during transportation after production, or during the handling for development or the like, the silver halide emulsion layer is also subject to such stresses. This exerts adverse influences on its photographic performances, causing undesirable problems such as desensitization, sensitization, and fog.

In recent years, the development of light-sensitive material has been speeded up and automated. Therefore, the light-sensitive material is liable to be bent or sucked during its transportation, and the degree of such bending or suction has become increasingly severe. This results in the application of high mechanical stresses on the silver halide emulsion layer. It has, therefore, been desired to develop a light-sensitive material which is improved in its resistance against such mechanical stresses.

In order to improve the stress resistance of light-sensitive materials, attempts have been made to improve the physical properties, e.g., flexibility, of a gelatin-containing hydrophilic layer (hereinafter referred to as a "gelatin layer").

For example, U.S. Pat. No. 2,960,404 discloses the addition of polyhydric alcohols such as glycerin, ethylene glycol, and 1,6-hexanediol to the gelatin layer, and British Pat. No. 738,637 discloses the addition of dialkyl phthalate. The addition of such compounds, however, suffers from serious disadvantages in that when the gelatin layer containing such compounds is placed under high temperature and high humidity conditions, the adhesion strength of the gelatin layer to a support is weakened, or contrarily the surface of the gelatin layer becomes excessively sticky, causing the problem of sticking to another surface.

Japanese patent application (OPI) Nos. 37919/72 (corresponding to U.S. Pat. No. 3,773,517), 21133/74 (corresponding to U.S. Pat. No. 3,967,966), 46018/78 (corresponding to U.S. Pat. No. 4,197,127), 109831/79 (corresponding to U.S. Pat. No. 4,301,240), and 76137/79 (corresponding to U.S. Pat. No. 4,145,221) (the term "OPI" as used herein refers to a "published unexamined Japanese patent application"), and Japanese Patent Publication Nos. 20432/74 (corresponding to British Pat. No. 1,293,252) and 24887/72 (corresponding to U.S. Pat. No. 3,620,751), etc., disclose techniques of increasing the dimensional stability and stress resistance of a silver halide emulsion layer by using polymer latexes having flexibility in combination with gelatin as binders for the silver halide emulsion layer.

Polymer latexes as used in such techniques are latexes containing an ester (e.g., a lower alkyl ester) of an ethylenically unsaturated carboxylic acid, such as acrylic acid and methacrylic acid, as a major recurring unit. The addition of such polymer latexes, however, is liable to cause problems such as desensitization, increased fog, loss of transparency during development and an increase in surface electric resistance.

SUMMARY OF THE INVENTION

An object of the invention is to provide a light-sensitive material which is less subject to the formation of fog and desensitization even if bent or strongly sucked by a sucking plate during the steps of producing, working, developing, and the like.

Another object of the invention is to provide a light-sensitive material which is free from the loss of transparency during development and is improved in its resistance against mechanical stresses.

A further object of the invention is to provide a light-sensitive material which is improved in its resistance against mechanical stresses without increasing its surface electric resistance.

Still another object of the invention is to provide a method of improving the stress resistance of a light-sensitive material without causing the loss of transparency during development, and further, without increasing its surface electric resistance.

It has been found that the objects can be attained by incorporating a styrene-butadiene copolymer latex into a gelatin layer of light-sensitive material.

The present invention, therefore, relates to a photographic silver halide light-sensitive material comprising a support with at least one gelatin-containing hydrophilic layer provided thereon wherein the gelatin-containing hydrophilic layer contains a styrene-butadiene copolymer latex.

DETAILED DESCRIPTION OF THE INVENTION

The term "styrene-butadiene copolymer" as used herein includes both a styrene-butadiene copolymer and other styrene-butadiene based polymers containing from about 0.1 to about 5 mol% of a different monomer or monomers (e.g., acrylic acid-based monomers) as a recurring unit.

Of these styrene-butadiene copolymers, the preferred one is a styrene-butadiene copolymer represented by the following formula:

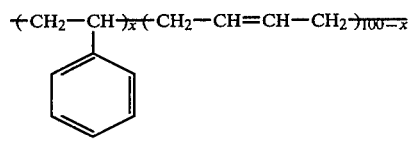

wherein x is usually 1 to 80% by weight, preferably from 1 to 60% by weight, and most preferably from 1 to 45% by weight.

Styrene-butadiene copolymer latexes as used herein can be prepared by reference to, for example, H. Asai, *Goseigomu Gaisetsu,* page 39, Asakura Shoten, Tokyo (1971); *Nippon Gomu Kyokaishi,* Vol. 50, No. 12, pp. 802–806 (1977); and D. C. Blackly, *High Polymer Science,* Vol. 1 pp. 284–295, Maclaren & Sons, Ltd., London. That is, they can be prepared by emulsion copolymerizing styrene and butadiene monomers in the presence of water, emulsifying agents, polymerization initiators, polymerization regulators (chain transfer agents), and the like.

Emulsifying agents which can be used include alkylphenolsulfonic acid monoester-based surface active agents, aliphatic acid-based soap, and rosined soap. The amount of the emulsifying agent used is from 0.05 to 5% by weight, preferably from 0.1 to 0.5% by weight, based on the total weight of solids.

Polymerization initiators which can be used include peroxides, such as $NaPO_4.10H_2O$, $K_2S_2O_8$, and $(NH_4)_2S_2O_8$, $FeSO_4.7H_2O$, and EDTA tetrasodium salt.

Polymerization regulators which can be used include primary or tertiary mercaptans containing from 6 to 18 carbon atoms, e.g., tert-dodecylmercaptan, tert-nonylmercaptan, and tert-decylmercaptan. The amount of the polymerization regulator used is preferably from 0.05 to 2.0% by weight based on the total weight. These polymerization regulators may be placed in a reactor prior to the start of polymerization, or may be added in small portions in the course of polymerization.

Polymerization terminators, e.g., hydroquinone and dimethyl carbamate, can be used to terminate the polymerization reaction at a suitable level. These compounds are added at a point at which the polymerization proceeds to a predetermined level. The amount of the polymerization terminator added is preferably about 0.1% by weight based on the total weight.

Although the concentration of the copolymer, i.e., solids, in the latex dispersion can be determined appropriately and optionally, it is usually from 10 to 60% by weight and preferably from 30 to 50% by weight.

Coating amount of the styrene-butadiene copolymer latex according to the present invention is 0.05 to 3 $g/m^2$ (as solids) and preferably 0.1 to 2 $g/m^2$.

The styrene-butadiene copolymer latex as used herein can be added to any of gelatin-containing hydrophilic layers, such as a silver halide emulsion layer, a surface protective layer, and an intermediate layer, of the light-sensitive material. In particular, it is preferred to add to the silver halide emulsion layer. The amount of the styrene-butadiene copolymer latex added is from 5 to 60% by weight, preferably from 10 to 50% by weight (as solids), based on the weight of the gelatin contained in the layer to which the latex is to be added.

Although the point at which the latex is added is not critical, when it is added to the silver halide emulsion layer, for example, it is preferably added after chemical aging of the silver halide emulsion and before coating of the silver halide emulsion on a support.

Light-sensitive silver halides which can be used in the preparation of the silver halide emulsion layer include silver chloride, silver bromide, silver iodide, and mixed silver halide, such as silver chlorobromide, silver iodobromide, and silver chloroiodobromide.

Silver halide particles are prepared by known techniques. It is useful to employ a single or double jet method, a control double jet method, and the like.

These photographic emulsions can be prepared by various techniques such as an ammonia method, a neutral method, and an acidic method, which are in common use and described in, for example, Mees, *The Theory of Photographic Process,* Macmillan, and P. Glafkides, *Chimie Photographique,* Paul Montel (1957).

Silver halide emulsions are usually chemically sensitized although so-called primitive emulsions, which are not subjected to chemical sensitization, can be used. For this chemical sensitization, the methods described in the above-described Glafkides reference and H. Frieser ed., *Die Grundlagen der Photographischen Prozesse mit Silberhalogeniden,* Akademische Verlagsgesellschaft (1968), can be employed. That is, a sulfur sensitization method in which compounds containing sulfur capable of reacting with silver ion, or activated gelatin is used, a reduction sensitization method in which reducing substances are used, a noble metal sensitization method in which noble metal (e.g., gold) compounds are used, etc., can be used alone or in combination with each other. Sulfur sensitizers which can be used include thiosulfuric acid salts, thioureas, thiazoles, and rhodanines. For noble metal sensitization, complex salts of metals of Group VIII of the Periodic Table, e.g., platinum, iridium, and palladium, as well as gold complex salts can be used.

To photographic emulsions as used herein can be added various compounds for the purpose of preventing fog during the production, storage or photographic processings of light-sensitive material, or stabilizing its photographic performance. That is, a number of compounds known as antifoggants or stabilizers can be used, including azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptotetrazole); mercaptopyrimidines; mercaptotriazines; thioketo compounds such as oxazolinethion; azaindenes such as triazaindenes, tetraazaindenes (in particular, 4-hydroxy-substituted (1,3,3a,7)tetraazindenes), and pentaazaindenes; benzenethiosulfonic acid; benzenesulfinic acid; and benzenesulfonic acid amide.

Binders which can be used in gelatin-containing hydrophilic layers such as a silver halide emulsion layer, and a surface protective layer include gelatin, gelatin derivatives, cellulose derivatives, e.g., hydroxyethyl cellulose, starth, and synthetic hydrophilic polymers, e.g., polyvinyl alcohol, poly-N-vinylpyrrolidone, polystyrene sulfonic acid, and polyacrylic acid. Gelatin includes acid-treated gelatin, alkali-treated gelatin, enzyme-treated gelatin, and the like.

The binder used in the gelatin-containing hydrophilic layers is preferably composed of at least 60% by weight of gelatin, more preferably at least 80% by weight of gelatin, and most preferably 100% by weight of gelatin.

The gelatin-containing hydrophilic layers of the invention may contain various surface active agents as coating aids, or for the purpose of preventing charging, improving sliding properties, improving emulsification, preventing adhesion, or improving photographic characteristics (e.g., acceleration of development, increasing gradation, and sensitization).

Surface active agents which can be used include:

nonionic surfactants such as saponin (steroid-based), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, and polyethylene oxide adducts of silicon), glycidol derivatives (e.g., alkenylsuccinic acid polyglyceride, and alkylphenol polyglyceride), aliphatic acid esters of polyhydric alcohols, and alkyl esters of saccharides;

anionic surfactants containing acidic groups, e.g., a carboxyl group, a sulfo group, a phospho group, a sulfuric acid ester group, and a phosphoric acid ester group, such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkyl polyoxyethylene alkylphenyl ethers, and polyoxyethylene alkylphosphoric acid esters;

amphoteric surfactants such as amino acids, aminoalkylsulfonic acids, aminoalkylsulfuric acid or phosphoric acid esters, alkylbetaines, and amine oxides;

cationic surfactants such as alkylamine salts, aliphatic or aromatic quaternary ammonium salts, heterocyclic quaternary ammonium salts, e.g., pyridinium and imidazolium, and alphatic or heterocyclic ring-containing phosphonium or sulfonium salts; and fluorine-containing surfactants.

These compounds are described in, for example, Belgian Pat. No. 742,680, British Pat. No. 1,496,534, and U.S. Pat. No. 3,888,678 (incorporated herein by reference to disclose such compounds).

The use of the above-described surfactants as antistatic agents makes it possible to prevent static marks from occurring. These static marks are created when a light-sensitive material is charged by friction with other materials or peeling during its transportation, and discharged.

Conventional acrylate-based latexes suffer from the defect that their effect as an antistatic agent decreases with a lapse of time. The use of the latexes of the invention, however, makes it possible to hold the initial antistatic effect.

Other additives, such as gelatin hardeners, spectral sensitizing dyes, dyestuffs, and matting agents, as used in the gelatin-containing hydrophilic layer of the invention, the support, and so forth are not critical in the invention. They can be selected by reference to, for example, *Research Disclosure,* Vol. 176, pp. 22–31 (December, 1978) and Japanese patent application (OPI) No. 99928/78 (corresponding to British Pat. No. 1,599,951).

A method of exposing the light-sensitive material of the invention is also not critical. Long exposure ranging from 1 second to several minutes, or short exposure of from $10^{-6}$ to $10^{-3}$ second can be employed.

In developing the light-sensitive material of the invention, automatic developing machines, e.g., a roller convey type automatic developing machine, a belt convey type automatic developing machine, and a hanger type automatic developing machine, are preferably used. The developing temperature is from 20° to 60° C. and preferably from 27° to 45° C., and the developing time is from 10 seconds to 10 minutes and preferably from 20 seconds to 5 minutes. In connection with the developing step, the composition of the processing solution, and so forth, C. E. K. Mees & T. H. James, ed., *The Theory of Photographic Processes,* 3rd Ed., Chapter 13, Macmillan Co. (1966) and L. F. A. Mason, *Photographic Processing Chemistry,* pp. 16–30, Oxford Press (1966), as well as the above-described *Research Disclosure* and Japanese patent application (OPI) No. 99928/78 can be referred to.

The following example is given to illustrate the invention in greater detail.

EXAMPLE

A silver iodobromide (silver iodide: 1.5 mol%) emulsion containing 80 g of gelatin per mol of silver halide was prepared, and was subjected to gold sensitization and sulfur sensitization in the usual manner.

This silver halide emulsion was divided into three portions. After the addition of latex as indicated in Table 1, polyoxyethylene alkyl ether (alkyl: $C_{12}$ to $C_{14}$), 2-hydroxy-4,6-dichloro-s-triazine sodium salt, and alkylbenzenesulfonic acid ($C_{12}$) were added to each portion so that their coating amounts were 40 mg/m$^2$, 30 mg/m$^2$, and 20 mg/m$^2$, respectively. The resulting mixtures were well stirred, and uniformly coated on a support (a 180 micron thick polyethylene terephthalate film provided with a subbing layer) and dried to prepare Samples 1 to 3.

As the latex, a styrene-butadiene copolymer latex (59 wt% styrene and 41 wt% butadiene) of the invention and a polyethyl acrylate latex as a control were used, and they were each added in an amount of 10% by weight (as solids).

With each sample, sensitivity, a reduction in the density of silver image due to mechanical stress, a reduction in the density of silver image due to suction, and a surface electric resistance were measured.

The samples were each developed with a developer, Fuji RD-II Developer (trade name, produced by Fuji Photo Film Co., Ltd.) at 32° C. for 40 seconds.

The sensitivity was indicated with that of Sample 1 as 100.

In the testing method to measure the reduction in the density of silver image due to mechanical stress, the sample was pressed around a cylindrical bar having a diameter of 1 cm and bent at an angle of 180°.

In the testing method to measure the reduction in the density of silver pattern due to suction, the sample was sucked at a pressure of 160 mm Hg for 3 seconds by means of a rubber suction cup having a diameter of 1 cm.

After the application of mechanical stress and suction, the sample was exposed to light and developed. The densities of areas where the mechanical stress or suction was applied and areas where the mechanical stress or suction was not applied were measured, and their density difference was calculated.

In connection with the surface electric resistance, after the sample was allowed to stand in an atmosphere of temperature of 25° C. and relative humidity of 25% for 1 hour, a pair of electrodes were placed on the surface of the sample with a distance of 1 cm therebetween, and current was allowed to flow across the electrodes to measure the surface electric resistance.

The surface electric resistance was measured immediately after the emulsion was coated and dried, and 2 months after the coating.

TABLE 1

| Sample No. | Type of Latex | Relative Sensitivity | Reduction in Density due to Bending (%) | Reduction in Density due to Suction (%) | Surface Electric Resistance just after Coating (Ω) | Surface Electric Resistance 2 Months after Coating (Ω) |
|---|---|---|---|---|---|---|
| 1 (control) | Not added | 100 | −24 | −11 | $6.3 \times 10^{11}$ | $6.3 \times 10^{11}$ |
| 2 (invention) | Styrene-butadiene latex | 104 | −14 | −2 | $6.3 \times 10^{11}$ | $6.3 \times 10^{11}$ |
| 3 (comparison) | Polyethyl acrylate latex | 98 | −16 | −3 | $8.5 \times 10^{11}$ | $1.5 \times 10^{13}$ |

Samples 4 and 5 were prepared in the same manner as in Samples 2 and 3, respectively, except that the latex was used in an amount of 30% by weight based on the gelatin. These samples were tested in the same manner as above with the results as shown in Table 2.

TABLE 2

| Sample No. | Type of Latex | Relative Sensitivity | Reduction in Density due to Bending (%) | Reduction in Density due to Suction (%) | Surface Electric Resistance just after Coating (Ω) | Surface Electric Resistance 2 Months after Coating (Ω) |
|---|---|---|---|---|---|---|
| 4 (invention) | Styrene-butadiene latex | 100 | −7 | 0 | $6.3 \times 10^{11}$ | $6.3 \times 10^{11}$ |
| 5 (comparison) | Polyethyl acrylate latex | 91 | −8 | 1 | $9.7 \times 10^{11}$ | $8.1 \times 10^{13}$ |

As apparent from Tables 1 and 2, for Samples 2 and 4 in which the styrene-butadiene copolymer latex of the invention is used, the reduction in density due to bending or suction can be prevented, and the sensitivity and the initial surface electric resistance can be maintained.

While the invention has been described in detail and with reference to specific embodiments thereof, it will be apparent to one skilled in the art that various changes and modifications can be made therein without departing from the spirit and scope thereof.

What is claimed is:

1. A photographic silver halide light-sensitive material comprising a support having coated thereon at least one gelatin-containing hydrophilic silver halide emulsion layer wherein said gelatin-containing hydrophilic silver halide emulsion layer contains gelatin as a binder and a styrene-butadiene copolymer latex; wherein said styrene-butadiene copolymer latex comprises a styrene-butadiene copolymer represented by the following formula:

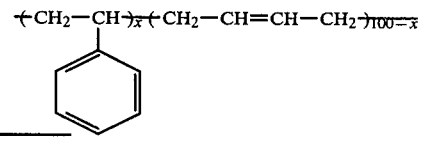

wherein x is 1 to 45% by weight and wherein the styrene-butadiene copolymer latex is present in a solid amount of 5 to 60% by weight based on the weight of the gelatin contained in the layer to which the latex is to be added.

2. A photographic silver halide light-sensitive material as claimed in claim 1, wherein the binder of the gelatin-containing hydrophilic silver halide emulsion layer is comprised of at least 60% by weight of gelatin.

3. A photographic silver halide light-sensitive material as claimed in claim 2, wherein the binder of the gelatin-containing hydrophilic silver halide emulsion layer is comprised of 100% by weight of gelatin.

4. A photographic silver halide light-sensitive material as claimed in claim 1, wherein the styrene-butadiene copolymer latex is present in a solid amount of 10 to 50% by weight based on the weight of the gelatin contained in the layer to which the latex is added.

5. The photographic silver halide light-sensitive material as claimed in claim 1, wherein the styrene-butadiene copolymer latex is present in a solid amount of 0.05 to 3 $g/m^2$.

6. A photographic silver halide light-sensitive material as claimed in claim 5, wherein the styrene-butadiene copolymer latex is present in a solid amount of 0.1 to 2 $g/m^2$.

* * * * *